United States Patent [19]

Laroche

[11] 4,422,681

[45] Dec. 27, 1983

[54] ANIMAL EXCREMENT PICKER

[76] Inventor: Sylvain Laroche, 855 Choquette, Beloeil, Canada

[21] Appl. No.: 341,869

[22] Filed: Jan. 22, 1982

[30] Foreign Application Priority Data

Feb. 17, 1981 [CA] Canada ..... 371054

[51] Int. Cl.[3] ..... A01K 29/00

[52] U.S. Cl. ..... 294/1 BA

[58] Field of Search ..... 294/1 BA, 1 B, 1 BB, 294/19 R, 19 A, 50, 50.5, 50.7, 65.5; 15/64, 104 R, 104.8, 142, 221, 236 R, 257.1, 257.3; 248/99, 101

[56] References Cited

U.S. PATENT DOCUMENTS 1,993,314 3/1935 Belford .
3,633,958 1/1972 Mesrobian .
4,046,383 9/1977 Vidnovic ..... 294/65.5
4,081,192 3/1978 Jones .
4,286,816 9/1981 Tobais ..... 294/1 BA

*Primary Examiner*—James B. Marbert
*Attorney, Agent, or Firm*—Cushman, Darby & Cushman

[57] ABSTRACT

The animal excrement picker described includes a handle with an elongated shank portion with a plate secured to the lower end thereof; a plurality of spikes are mounted to this plate and are enclosed in a housing that includes a top wall and a downwardly extending peripheral side wall; inside the housing, a perforated plate is provided with a series of openings, each in axial alignment with a respective spike; the top wall of the housing has a collar portion which frictionally engages the shank portion of the handle so that the spikes will remain in a lowermost position after having picked an excrement; a metallic plate may be added to the picker housing to close the open end thereof and is fixed thereto by means of magnets mounted to the side wall of the housing.

5 Claims, 3 Drawing Figures

ANIMAL EXCREMENT PICKER

FIELD OF THE INVENTION

The present invention pertains to pickers and, more particularly, to a device for gathering animal excrement.

BACKGROUND OF THE INVENTION

Presently known animal excreta pick-up devices have covers that snap on the device once it has been used. Such devices may be found described for example in U.S. Pat. Nos. 3,740,086 issued June 19, 1973 to Rossitto, 3,802,728 issued Apr. 9, 1974 to Giacopelli and 4,058,337 issued Nov. 15, 1977 to Isac. These devices required the use of a cover so that the excrement can be held until discharged at an appropriate location. One disadvantage of such devices is that, frequently, the mechanism for opening and closing the covers do not operate properly as a result of damage or rust.

OBJECTS AND STATEMENTS OF THE INVENTION

It is an object of the present invention to provide an animal scoop which does not necessarily require the use of a cover to hold the picked up excrement until it can be discharged at a desired location.

It is also an object of this invention to provide a device which allows the pick-up of the excrement independently of the consistency of the latter. This is achieved by providing the animal scoop with a plurality of spikes which engage the excrement and which allow the spikes to retain it so that it may be carried and discharged only where desired.

The present invention therefore relates to an animal excrement picker which comprises: a handle with an elongated shank portion having a cross-section of a given shape; a plate secured to one end of the shank portion; a plurality of spikes fixed to the plate and extending downwardly therefrom; a housing having a top wall and side wall means extending peripherally and downwardly to define an enclosure with an open end; a perforated plate mounted within the housing and to the side wall means, the perforated plate extending parallel to the top wall between the top wall and the open end and including a plurality of openings, each in axial alignment with a respective spike so as to allow its passage therethrough; the top wall has a collar portion with an opening, in the region of the handle, with a shape corresponding to that of the shank portion and a dimension such as to cause frictional contact between the handle and the collar portion to hold the spike plate in its lowermost position after an excrement has been spiked.

In one variant of the present invention, a metallic plate may be provided to close the open end of the housing; it is retained to the housing by means of magnets secured to the outside wall of the housing.

Other advantages and objects of the present invention will become apparent from the detailed description of the invention given hereinbelow; it is wished to have it understood that the preferred embodiments described can be modified and refined in various ways.

DESCRIPTION OF PREFERRED EMBODIMENTS

Figure 1:
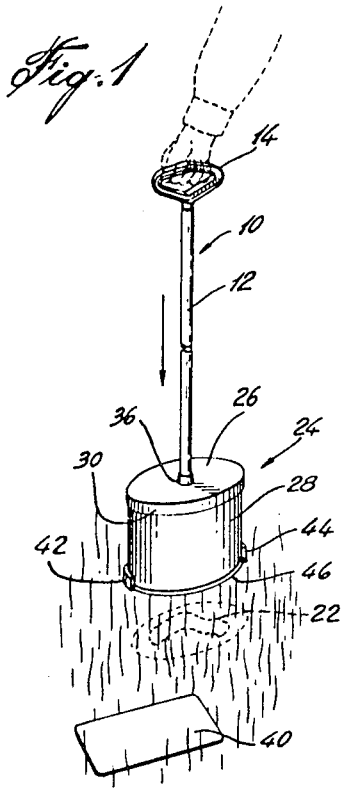
FIG. 1 is a perspective view of the animal excrement picking device embodying the features of the present invention.

Referring to the drawings, the animal excrement picker comprises a handle, generally denoted 10, which comprises an elongated shank portion 12 with a gripping portion 14 at one end thereof and a plate 16 fixedly mounted to the other end thereof. In the embodiment illustrated, plate 16 comprises a central hub portion 18 which fits into the hollow shank portion 12. Other means of securing the plate to the shank portion are also possible. To the lower side of plate 16 are secured a plurality of spikes 20 which, in the embodiment illustrated, are in the form of nails; other elongated pin-like structures can be used. The provision of many spikes and having them very close together permits the pick-up of excrement, such as 22, that may have a large range of consistency.

The excrement picker also includes a housing, generally denoted 24, which consists of a top wall 26 and of a peripheral side wall 28 that extend downwardly from the top wall. In the embodiment illustrated, the peripheral wall portion is press fitted inside the downwardly extending peripheral edge 30 of the top wall. Also, in the preferred embodiment illustrated, the housing has an oval shape to facilitate the covering of the entire animal excrement such as shown in FIG. 1.

A perforated plate 32 is integrally mounted to the inner wall of the side wall 28. Wall 32 extends parallel to the top wall 26 and includes a series of openings 34 which are each in axial alignment with a corresponding spike 20 so as to allow the free passage therethrough.

Figure 2:
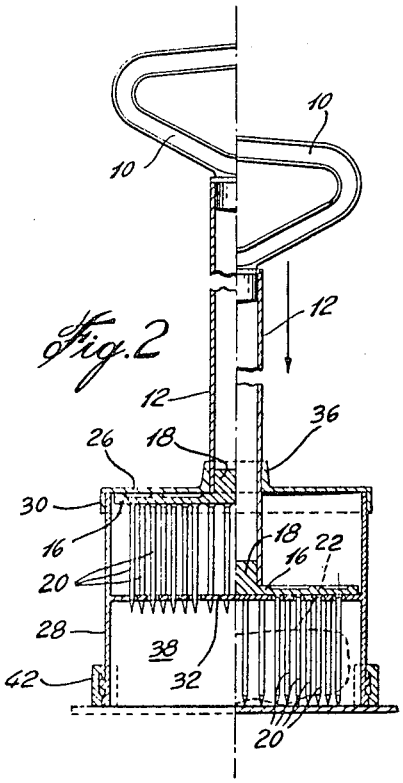
FIG. 2 is a cross-sectional elevational view showing the spike portion of the device in the uppermost position (left side) and lowermost (right side) positions.
Figure 3:
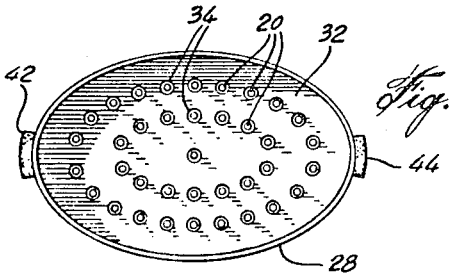
FIG. 3 is a bottom view of the device.

The top wall 26 has a collar portion 36 which, extends upwardly and includes a central opening having a shape corresponding to the shape of the cross-section of the shank portion 12. The dimension of the opening of collar 36 must be such as to frictionally engage the outer wall of the shank portion 12 so that the free movement of the shank portion 12 through this opening will be prevented. This frictional contact must be sufficient to resist upward movement of the handle with the spike plate after an excrement has been spiked. Otherwise, such excrement would be freed as the spikes would move through the openings and the excrement contacting plate 32. Hence, in the position shown on the right-hand of FIG. 2 (where an excrement is spiked), the lifting up of the picker will be done leaving the spikes in their lowermost excrement-picking position. Similarly, when the device is as shown on the left-hand side of Fig. 2, the spike-carrying plate will remain in its uppermost position.

To free the excrement, a given force will be exerted on the handle 10 to overcome the friction between the shank portion and the collar portion thereby lifting up the spike plate and disengaging the excrement.

In another form of the present invention, to ensure that the excrement will remain in the housing compartment 38, especially in cases where the excrement 22 is in a very fluid consistency, it may be useful to have a metallic plate 40 closing the open end of compartment 38. This metallic plate may have any shape; however, it should be of such a dimension as to exceed the lower edge 46 of side wall 28. A pair of magnets 42,44 are mounted to side wall 28 to hold the plate in covering engagement with the open end of the housing. One advantage of having plate 40 exceeding the lower peripheral edge 46 of the housing is that it can be removed by simply placing one's foot on the protruding portion of the plate and lifting the picker to free the open end.

To ensure adequate frictional contact between collar 36 and the shank portion 12, the device should be made from plastics material. This also enables the device to be washed after use without any risk of rust which, in the case of metal, would affect the frictional contact needed between the shank portion and the collar portion.

The embodiments of the invention in which an exclusive property or privilege is claimed are defined as follows:

1. An animal excrement picker comprising: a handle having an elongated shank portion with a cross-section of a given shape; a plate secured to one end of said shank; a plurality of spikes mounted to said plate extending downwardly therefrom; a housing having a top wall and sidewall means extending peripherally and downwardly from said top wall to define therewith an enclosure with an open end; a perforated plate mounted within said housing and to said sidewall means, said perforated plate extending parallel to said top wall between said top wall and said open end and including a plurality of openings, each in axial alignment with a respective spike so as to allow passage of said spike therethrough; said top wall having a collar portion with an opening in the region of said handle, said opening having a shape corresponding to that of said shank portion and a dimension such as to cause frictional contact between said handle and said collar portion of said top wall to thereby prevent relative free movement therebetween and to hold said spikes in a lowermost position after an excrement has been spiked.

2. An animal excrement picker as defined in claim 1, further comprising magnet means on said sidewall means adjacent said open end and a metallic plate closing said open end when contacted by said magnet means.

3. An animal excrement picker as defined in claim 2, wherein said metallic plate has a dimension larger than that of said open end so as to define a protruding portion when in covering engagement with said open end whereby said metallic plate can be removed by applying one's foot on said protruding portion of said metallic plate.

4. An animal excrement picker as defined in claim 1, 2 or 3, wherein said housing has an oval shape.

5. An animal excrement picker as defined in claim 1, 2 or 3, wherein said housing and said handle are made of plastics material.

* * * * *